US011200827B2

(12) United States Patent
Bao et al.

(10) Patent No.: US 11,200,827 B2
(45) Date of Patent: Dec. 14, 2021

(54) CHROMATICITY COMPENSATION METHOD, CHROMATICITY COMPENSATION DEVICE AND STORAGE MEDIUM

(71) Applicants: Hefei Xinsheng Optoelectronics Technology Co., Ltd., Anhui (CN); BOE Technology Group Co., Ltd., Beijing (CN)

(72) Inventors: Wenchao Bao, Beijing (CN); Xiaolong Wei, Beijing (CN); Dongxu Han, Beijing (CN)

(73) Assignees: Hefei Xinsheng Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 157 days.

(21) Appl. No.: 16/429,830

(22) Filed: Jun. 3, 2019

(65) Prior Publication Data

US 2020/0135084 A1 Apr. 30, 2020

(30) Foreign Application Priority Data

Oct. 29, 2018 (CN) ..... 201811269932.0

(51) Int. Cl.
*G09G 5/02* (2006.01)
*G09G 3/20* (2006.01)

(52) U.S. Cl.
CPC ... *G09G 3/2003* (2013.01); *G09G 2320/0242* (2013.01); *G09G 2320/0666* (2013.01)

(58) Field of Classification Search
CPC ..... G09G 3/2003; G09G 2320/0242; G09G 2320/0666; G09G 2320/0686; G09G 2360/145; G09G 5/02
See application file for complete search history.

(56) References Cited

U.S. PATENT DOCUMENTS 6,263,120 B1 * 7/2001 Matsuoka ..... G06T 3/403 382/300
8,743,140 B2 6/2014 Dai et al.
(Continued)

FOREIGN PATENT DOCUMENTS

CN 102291554 A 12/2011
CN 102509541 A 6/2012
(Continued)

OTHER PUBLICATIONS

Feb. 5, 2020—(CN) First Office Action Appn 201811269932.0 with English Translation.

*Primary Examiner* — Lunyi Lao
*Assistant Examiner* — Jarurat Suteerawongsa
(74) *Attorney, Agent, or Firm* — Banner & Witcoff, Ltd.

(57) ABSTRACT

A chromaticity compensation method, a chromaticity compensation device and a storage medium are disclosed. The chromaticity compensation method includes that, according to a preset standard chromaticity value and measured chromaticity values corresponding to a plurality of sub-display regions in a display region, chromaticity compensation values of the sub-display regions are determined, and the display region is divided into the plurality of sub-display regions in close arrangement, and each of the sub-display regions includes a plurality of sub-pixels; a data smoothing treatment is performed between the chromaticity compensation values of the sub-display regions that are adjacent, so as to determine the smoothed chromaticity compensation values of the sub-pixels in the sub-display regions; and upon display, chromaticity compensation of the sub-pixels are performed by adopting the smoothed chromaticity compensation values.

9 Claims, 5 Drawing Sheets

(56) References Cited

U.S. PATENT DOCUMENTS

| | | | | |
|---|---|---|---|---|
| 9,747,851 | B2 | 8/2017 | Zhang et al. | |
| 9,858,889 | B2 | 1/2018 | Zhao et al. | |
| 10,360,868 | B2 | 7/2019 | Liu | |
| 2010/0189349 | A1* | 7/2010 | Miyasaki | G06T 5/002 382/167 |
| 2013/0222414 | A1* | 8/2013 | Ito | G09G 5/02 345/600 |
| 2014/0140611 | A1* | 5/2014 | Yasuoka | G06T 3/4007 382/159 |
| 2017/0193933 | A1* | 7/2017 | Zhang | G09G 3/36 |

FOREIGN PATENT DOCUMENTS

| | | | |
|---|---|---|---|
| CN | 102291554 | B | 1/2013 |
| CN | 102509541 | B | 6/2014 |
| CN | 105100763 | A | 11/2015 |
| CN | 105206239 | A | 12/2015 |
| CN | 105355182 | A | 2/2016 |
| CN | 107256699 | A | 10/2017 |
| CN | 107591120 | A | 1/2018 |
| CN | 107863080 | A | 3/2018 |

* cited by examiner

CHROMATICITY COMPENSATION METHOD, CHROMATICITY COMPENSATION DEVICE AND STORAGE MEDIUM

CROSS-REFERENCE TO RELATED APPLICATION

The present application claims priority of Chinese Patent Application No. 201811269932.0 filed on Oct. 29, 2018, the disclosure of which is incorporated herein by reference in its entirety as part of the present application.

TECHNICAL FIELD

Embodiments of the present disclosure relate to a chromaticity compensation method, a chromaticity compensation device and a storage medium.

BACKGROUND

With the continuous development of display technology, people have higher and higher requirements for display quality of display panels, while chromaticity unevenness of display panels can have a great impact on the display quality of display panels.

SUMMARY

At least one embodiment of the present disclosure provides a chromaticity compensation method, comprising based on a preset standard chromaticity value and measured chromaticity values corresponding to a plurality of sub-display regions in a display region, determining chromaticity compensation values of respective sub-display regions, wherein the display region is divided into the plurality of sub-display regions in a close arrangement, and each of the sub-display regions comprises a plurality of sub-pixels; conducting a data smoothing treatment between the chromaticity compensation values of the respective sub-display regions that are adjacent and determining smoothed chromaticity compensation values of respective sub-pixels in the respective sub-display regions; and upon display, chromatically compensating the respective sub-pixels by using the smoothed chromaticity compensation values.

For example, in the chromaticity compensation method according to an embodiment, the plurality of sub-display regions are closely arranged in a first direction; conducting a data smoothing treatment between the chromaticity compensation values of the respective sub-display regions that are adjacent and determining smoothed chromaticity compensation values of respective sub-pixels in the respective sub-display regions comprises: smoothing the chromaticity compensation values corresponding to two of the sub-display regions adjacent in the first direction by using a linear interpolation method, and determining the linearly smoothed chromaticity compensation values corresponding to the respective sub-pixels as the smoothed chromaticity compensation values.

For example, in the chromaticity compensation method according to an embodiment, the plurality of sub-display regions are closely arranged in a second direction; conducting a data smoothing treatment between the chromaticity compensation values of the respective sub-display regions that are adjacent and determining smoothed chromaticity compensation values of respective sub-pixels in the respective sub-display regions comprises: smoothing the chromaticity compensation values corresponding to two of the sub-display regions adjacent in the second direction by using the linear interpolation method, and determining the linearly smoothed chromaticity compensation values corresponding to the respective sub-pixels are determined as the smoothed chromaticity compensation values; wherein the first direction and the second direction are perpendicular to each other.

For example, in the chromaticity compensation method according to an embodiment, for a center zone of four of the sub-display regions closely arranged in a first direction and a second direction, conducting a data smoothing treatment between the chromaticity compensation values of the respective sub-display regions that are adjacent and determining smoothed chromaticity compensation values of respective sub-pixels in the respective sub-display regions comprises: smoothing the chromaticity compensation values corresponding to the four of the sub-display regions by using a bi-linear interpolation method, and determining bi-linearly smoothed chromaticity compensation values corresponding to the sub-pixels within the center zone are determined as the smoothed chromaticity compensation values, wherein the first direction and the second direction are perpendicular to each other.

For example, in the chromaticity compensation method according to an embodiment, determining the chromaticity compensation values of the respective sub-display regions based on the measured chromaticity values corresponding to the plurality of sub-display regions in the display region and the preset standard chromaticity value comprises: acquiring the measured chromaticity values of center positions of the respective sub-display regions; and according to a difference between the measured chromaticity values and the preset standard chromaticity value, determining the chromaticity compensation values corresponding to the respective sub-display regions.

An embodiment of the present disclosure provides a chromaticity compensation device, comprising: an acquiring module, configured to determine chromaticity compensation values of respective sub-display regions based on a preset standard chromaticity value and measured chromaticity values corresponding to a plurality of sub-display regions in a display region, wherein the display region is divided into the plurality of sub-display regions in a close arrangement, and each of the sub-display regions includes a plurality of sub-pixels; a smoothing module, configured to conduct a data smoothing treatment between the chromaticity compensation values of the respective sub-display regions that are adjacent, and determine smoothed chromaticity compensation values of respective sub-pixels in the respective sub-display regions; and a compensating module, configured to conduct chromatically compensate the respective sub-pixels by using the smoothed chromaticity compensation values upon display.

For example, the chromaticity compensation device according to an embodiment of the present disclosure, in a case where the plurality of sub-display regions are closely arranged in a first direction, the smoothing module is further configured to smooth the chromaticity compensation values corresponding to two of the sub-display regions adjacent in the first direction by using a linear interpolation method, and determine the linearly smoothed chromaticity compensation values corresponding to the respective sub-pixels as the smoothed chromaticity compensation values.

For example, the chromaticity compensation device according to an embodiment of the present disclosure, in a case where the plurality of sub-display regions are closely arranged in a second direction, the smoothing module is further configured to smooth the chromaticity compensation values corresponding to two of the sub-display regions adjacent in the second direction by using the linear interpolation method, and determine the linearly smoothed chromaticity compensation values corresponding to the respective sub-pixels as the smoothed chromaticity compensation values; wherein the first direction and the second direction are perpendicular to each other.

For example, the chromaticity compensation device according to an embodiment of the present disclosure, for a center zone of four of the sub-display regions closely arranged in a first direction and a second direction, the smoothing module is further configured to smooth the chromaticity compensation values corresponding to the four of the sub-display regions by using a bi-linear interpolation method, and determine bi-linearly smoothed chromaticity compensation values corresponding to the sub-pixels within the center zone as the smoothed chromaticity compensation values; wherein the first direction and the second direction are perpendicular to each other.

An embodiment of the present disclosure provides a chromaticity compensation device, comprising: a processor; a memory; one or a plurality of computer program modules, wherein the one or the plurality of computer program modules are stored in the memory and are configured to be executed by the processor, upon the one or the plurality of computer program modules being executed by the processor, the following method is executed: based on a preset standard chromaticity value and measured chromaticity values corresponding to a plurality of sub-display regions in a display region, determining chromaticity compensation values of respective sub-display regions, wherein the display region is divided into the plurality of sub-display regions in a close arrangement, each of the sub-display regions comprises a plurality of sub-pixels; conducting a data smoothing treatment between the chromaticity compensation values of the respective sub-display regions that are adjacent, and determining smoothed chromaticity compensation values of respective sub-pixels in the respective sub-display regions; and upon display, chromatically compensating the respective sub-pixels by using the smoothed chromaticity compensation values.

For example, the chromaticity compensation device according to an embodiment of the present disclosure, upon the one or the plurality of computer program modules being executed by the processor, the following method is further executed: in a case where the plurality of sub-display regions are closely arranged in a first direction, smoothing the chromaticity compensation values corresponding to two of the sub-display regions adjacent in the first direction by using a linear interpolation method, and determining linearly smoothed chromaticity compensation values corresponding to the respective sub-pixels as the smoothed chromaticity compensation values.

For example, the chromaticity compensation device according to an embodiment of the present disclosure, upon the one or the plurality of computer program modules being executed by the processor, the following method is further executed: in a case where the plurality of sub-display regions are closely arranged in a second direction, smoothing the chromaticity compensation values corresponding to two of the sub-display regions adjacent in the second direction by the linear interpolation method, and determining the linearly smoothed chromaticity compensation values corresponding to the sub-pixels, wherein the first direction and the second direction are perpendicular to each other as the smoothed chromaticity compensation values.

For example, the chromaticity compensation device according to an embodiment of the present disclosure, upon the one or the plurality of computer program modules being executed by the processor, the following method is further performed: for a center zone of four of the sub-display regions closely arranged in the first direction and the second direction, smoothing the chromaticity compensation values corresponding to the four of the sub-display regions by using a bi-linear interpolation method, and determining bi-linearly smoothed chromaticity compensation values corresponding to the sub-pixels within the center zone as the smoothed chromaticity compensation values.

For example, the chromaticity compensation device according to an embodiment of the present disclosure, determining chromaticity compensation values of the respective sub-display regions based on the measured chromaticity values corresponding to the plurality of sub-display regions in the display region and the preset standard chromaticity value includes: acquiring the measured chromaticity values of center positions of the respective sub-display regions; and according to a difference between the measured chromaticity values and the preset standard chromaticity value, determining the chromaticity compensation values corresponding to the respective sub-display regions.

An embodiment of the present disclosure provides a nonvolatile storage medium, comprising a program code, wherein upon the program code being run on a computing device, the program code is executed to cause the computing device to execute steps of the chromaticity compensation method according to an embodiment of the present disclosure.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
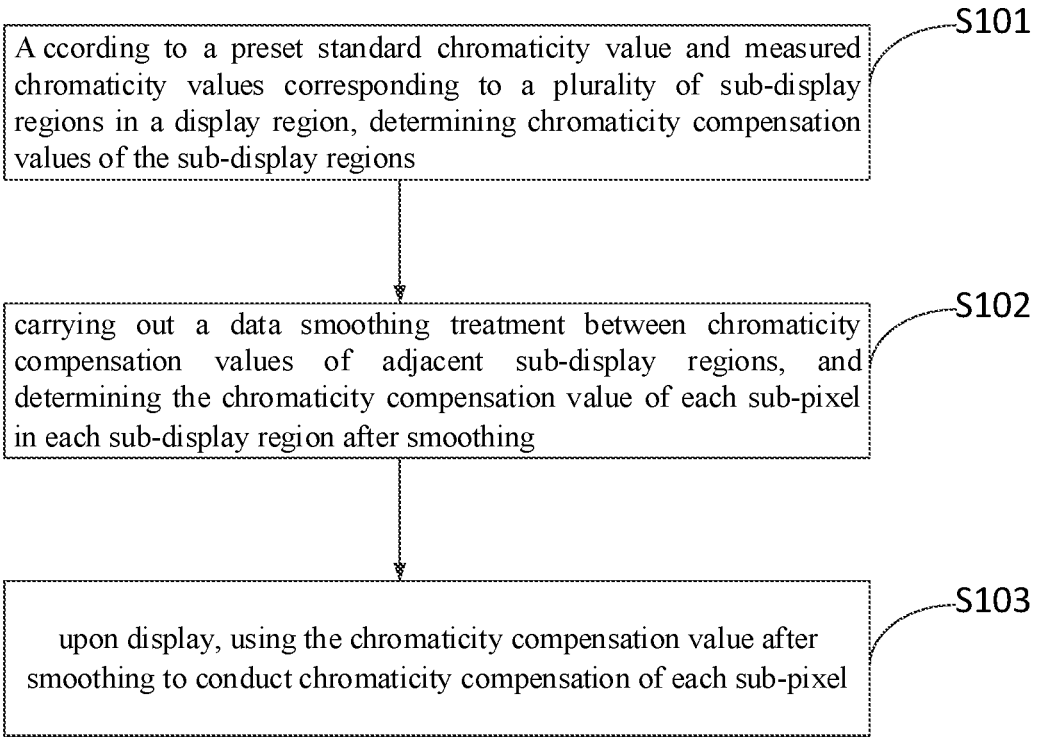
FIG. 1 is a flowchart of a chromaticity compensation method provided by at least an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Hereinafter, various embodiments of the present disclosure will be described in detail with reference to the accompanying drawings. It should be noted that in the accompanying drawings, the same reference numerals are assigned to components with essentially the same or similar structures and functions, and repeated descriptions thereof will be omitted.

In the process of manufacturing a display panel, due to technical reasons, it may not assure to form a film layer evenly, which will result in that chromaticity difference of varied degrees appears in different regions of the display panel upon display. For the sake of compensating the chromaticity values of respective sub-pixels within the display panel to reduce the chromaticity difference of respective regions, one chromaticity compensation method is as follows: selecting a center zone of the display panel as a reference point, measuring a chromaticity compensation value of the center zone, and compensating the sub-pixels in the whole display panel in chromaticity based on the chromaticity compensation value of the center zone. Because the whole panel is compensated by the compensation method merely based on one reference point and a same chromaticity compensation value, the chromaticity compensation effect thereof is not good, so that the problem of chromaticity unevenness presented by the display panel upon display cannot be well solved.

According to at least an embodiment of the present disclosure, there is provided a chromaticity compensation method, which includes that, according to a preset standard chromaticity value and measured chromaticity values corresponding to a plurality of sub-display regions in a display region, chromaticity compensation values of the sub-display regions are determined, wherein the display region is divided into the plurality of the sub-display regions in a close arrangement, each of which includes a plurality of sub-pixels; a data smoothing treatment is carried out between the chromaticity compensation values of the sub-display regions that are adjacent, so that smoothed chromaticity compensation values of the sub-pixels in the sub-display regions are determined; during display, the smoothed chromaticity compensation values are used to conduct chromaticity compensation of the sub-pixels.

According to at least an embodiment of the present disclosure, there are also provided a chromaticity compensation device and a storage medium corresponding to the above chromaticity compensation method.

With the chromaticity compensation method provided by at least an embodiment of the present disclosure, by means of dividing a display region into a plurality of sub-display regions in a close arrangement, chromaticity compensation values corresponding to the sub-display regions, respectively, are determined according to a preset standard chromaticity value and measured chromaticity values corresponding to the sub-display regions; by conducting a smoothing treatment on the chromaticity compensation values corresponding to the sub-display regions, the smoothed chromaticity compensation value of each sub-pixel within each sub-display region is determined. Upon display, the smoothed chromaticity compensation value is used to conduct chromaticity compensation of each sub-pixel, so as to realize a pertinent chromaticity compensation of sub-pixels in different places of the display region and reduce the chromaticity difference of a display picture. As a result, display quality of the display panel can be improved.

Herein, "close arrangement" means that the objects that are arranged in a line or in an array are directly adjacent.

Some embodiments and examples of the present disclosure will be described in detail below in conjunction with the attached drawings.

FIG. 1 is a flowchart illustrating a chromaticity compensation method provided by at least an embodiment of the present disclosure. The chromaticity compensation method can be used to compensate for the uneven chromaticity rendered by a display panel (for example, an organic light-emitting diode display panel, a quantum dot light-emitting diode display panel, etc.) upon display. As shown in FIG. 1, the chromaticity compensation method includes step S101 to step S103.

S101: according to a preset standard chromaticity value and measured chromaticity values corresponding to a plurality of sub-display regions in a display region, determining chromaticity compensation values of the sub-display regions, wherein the display region is divided into a plurality of sub-display regions that are closely arranged, and each of the sub-display regions includes a plurality of sub-pixels.

For example, in some examples, step S101 may include: obtaining a measured chromaticity value of the center position of each sub-display region; and determining the chromaticity compensation value corresponding to each sub-display region according to a difference between the measured chromaticity value and a preset standard chromaticity value. For example, it is possible that the measured chromaticity of the sub-display region is represented by means of measuring the chromaticity value of the center position of each sub-display region with an optical measuring instrument, and it is possible that, based on the measured chromaticity value of each sub-display region and the preset standard chromaticity value, namely, by comparing the measured chromaticity value with the preset standard chromaticity value, the chromaticity compensation value of each sub-display region is calculated with the aid of a preset algorithm. It is to be noted that, for different display panels, the standard chromaticity value to be set for these display panels may differ, and specific setting of the preset standard chromaticity value may also be selected according to the actual use condition. Embodiments of the present disclosure are not limited in this aspect.

S102: carrying out a data smoothing treatment between chromaticity compensation values of adjacent sub-display regions, and determining the chromaticity compensation value of each sub-pixel in each sub-display region after smoothing.

For example, in some examples, chromaticity compensation values of adjacent sub-display regions may be smoothed by a linear interpolation method, so as to determine the chromaticity compensation value of each sub-pixel in each sub-display region after smoothing. The linear interpolation method is a simple interpolation method widely used in mathematics, computer graphics and other fields, and regarding the concrete operating process of the linear interpolation method, reference may be made to the description of linear interpolation process in the following text. It is to be noted that, in embodiments of the present disclosure, the method for data smoothing treatment may also include interpolation method of other types, and is not limited to linear interpolation method, and embodiments of the present disclosure do not set a limit to this.

S103: upon display, using the chromaticity compensation value after smoothing to conduct chromaticity compensation of each sub-pixel.

For example, in some examples, when the display panel is used for display, the chromaticity compensation value after smoothing may be used to conduct chromaticity compensation of each sub-pixel. Thus, the chromaticity compensation of sub-pixels in different places of the display region is realized correspondingly, and the chromaticity difference of a display picture is reduced.

Figure 2A:
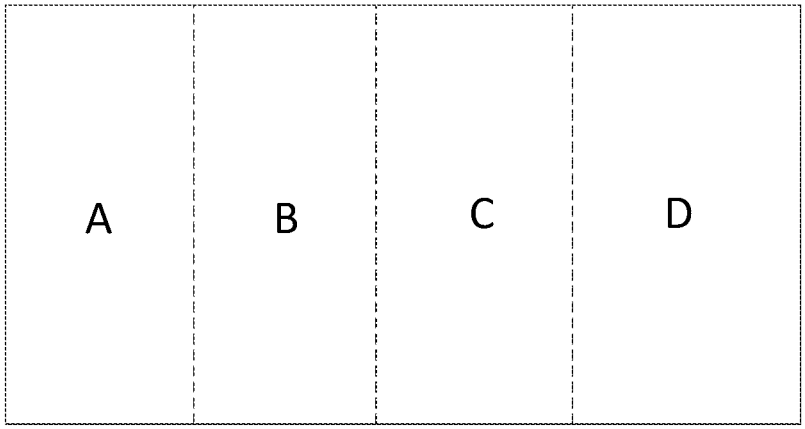
FIG. 2A is one of schematic structural diagrams of a sub-display region division in a chromaticity compensation method provided by at least an embodiment of the present disclosure.
Figure 2B:
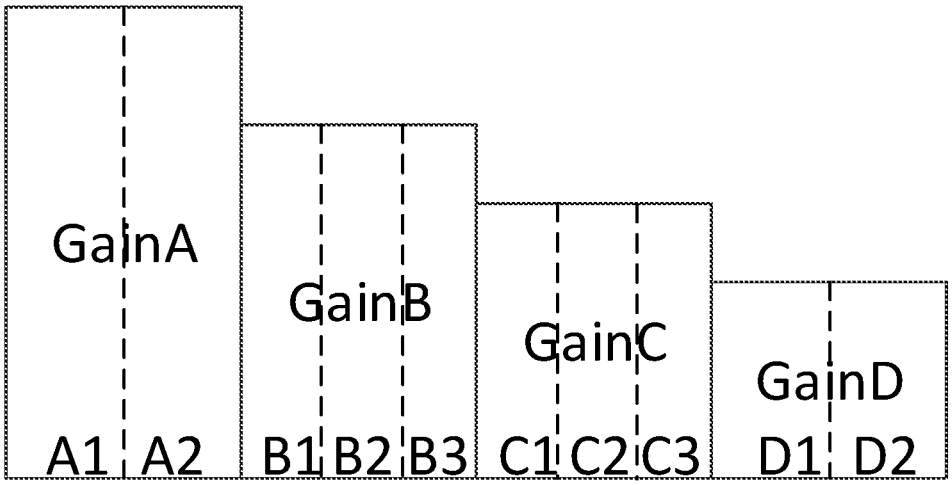
FIG. 2B is a schematic diagram of chromaticity compensation values corresponding to respective sub-display regions in the chromaticity compensation method shown in FIG. 2A.
Figure 2C:
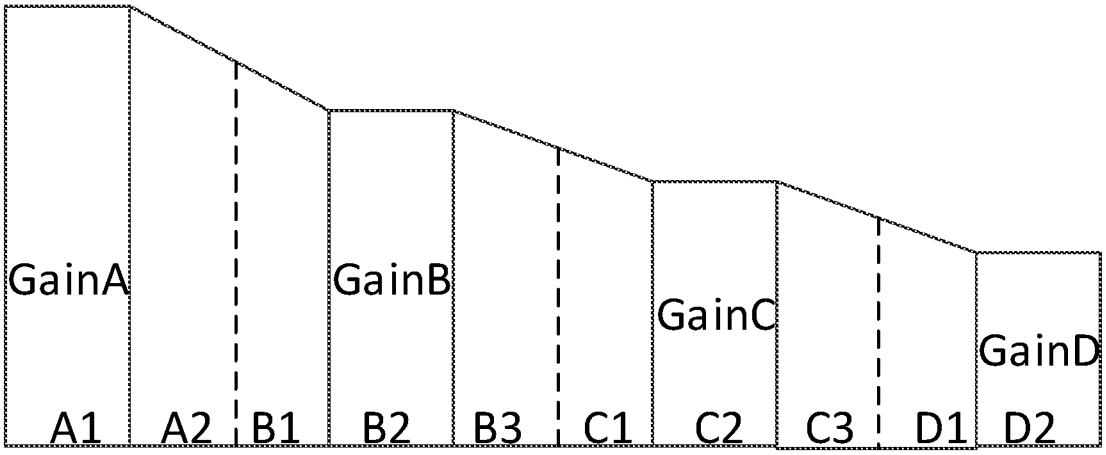
FIG. 2C is a schematic diagram of smoothed chromaticity compensation values of respective sub-display regions in the chromaticity compensation method shown in FIG. 2A.

FIG. 2A is one of structurally schematic diagrams illustrating the sub-display region division in a chromaticity compensation method provided by at least an embodiment of the present disclosure, FIG. 2B is a schematic diagram illustrating chromaticity compensation values corresponding to sub-display regions in the chromaticity compensation method shown in FIG. 2A, and FIG. 2C is a schematic diagram illustrating smoothed chromaticity compensation values of the sub-display regions in the chromaticity compensation method shown in FIG. 2A.

As shown in FIG. 2A, in the chromaticity compensation method provided by the embodiment, a plurality of sub-display regions (for example, four sub-display regions A, B, C and D shown in FIG. 2A) are closely arranged in a first direction. Hereinafter, with reference to an example in which the plurality of sub-display regions include four sub-display regions A, B, C and D, which are closely arranged in the first direction, the chromaticity compensation method provided by the embodiment will be described in detail.

For example, in some examples, as shown in FIG. 2A, a display region is divided into four sub-display regions A, B, C, and D closely arranged in the first direction. For example, in step S101, chromaticity compensation values GainA, GainB, GainC and GainD corresponding to the sub-display regions can be determined based on a preset standard chromaticity value and measured chromaticity values corresponding to the sub-display regions (for concrete details, reference may be made to the foregoing description about step S101), and for example, the chromaticity compensation values corresponding to sub-display regions are shown in FIG. 2B.

For example, in some examples, as shown in FIG. 2C, in step S102, a data smoothing treatment may be conducted on the chromaticity compensation values corresponding to two sub-display regions adjacent in the first direction by a linear interpolation method, so as to obtain the smoothed chromaticity compensation value corresponding to each sub-pixel within each sub-display region. For example, when the data smoothing treatment is conducted on the chromaticity compensation values corresponding to two adjacent sub-display regions, each of the sub-display regions may be divided further. For example, specifically, as shown in FIG. 2B and FIG. 2C, sub-display regions A and D located at the edges of a display region in the first direction may be divided into two secondary regions in the first direction, respectively. That is, the sub-display region A is divided into two secondary regions A1 and A2, and the sub-display region D is divided into two secondary regions D1 and D2. It is also possible to divide sub-display regions B and C located in the middle of the display region in the first direction into three secondary regions in the first direction, respectively. That is, the sub-display region B is divided into three secondary regions B1, B2 and B3, and the sub-display region C is divided into three secondary regions C1, C2 and C3. Chromaticity compensation values GainA, GainB, GainC and GainD corresponding to the sub-display regions A, B, C and D are taken as chromaticity compensation values of the secondary regions A1, B2, C2 and D2, respectively. Thus, the smoothed chromaticity compensation value of each sub-pixel in A2 and B1 can be obtained by linear interpolation based on chromaticity compensation values of A1 and B2, the smoothed chromaticity compensation value of each sub-pixel in B3 and C1 can be obtained by linear interpolation based on chromaticity compensation values of B2 and C2, and the smoothed chromaticity compensation value of each sub-pixel in C3 and D1 can be obtained by linear interpolation based on chromaticity compensation values of C2 and D2. It is to be noted that, in the present embodiment, for the sub-display regions located at the edges of a display region in the first direction, with the sub-display region A as an example, its chromaticity compensation value GainA may be a chromaticity compensation value for the center position of the sub-display region A that is obtained according to step 101, and may also be a chromaticity compensation value for the center position of the secondary display region A1 that is obtained according to step 101, and embodiments of the present disclosure are not limited in this aspect. It is also to be noted that, the operating process of smoothing here is exemplary, and embodiments of the present disclosure are not limited in this aspect.

For example, in some examples, in step S103, smoothed chromaticity compensation values obtained in FIG. 2C may be used to conduct chromaticity compensation of each sub-pixel when the display panel is used for display, and thus, uneven chromaticity of the display region in the first direction can be compensated.

It is to be noted that, in the chromaticity compensation method provided by the present embodiment, description has been made with reference to an example in which a display region is divided into four sub-display regions in the first direction, and in the course of actual operation, a display region may be divided into more than one (e.g., two, three, five or more), and is not limited to four. Its specific number may be selected according to the actual use condition, and the present disclosure does not limit this.

Figure 3A:
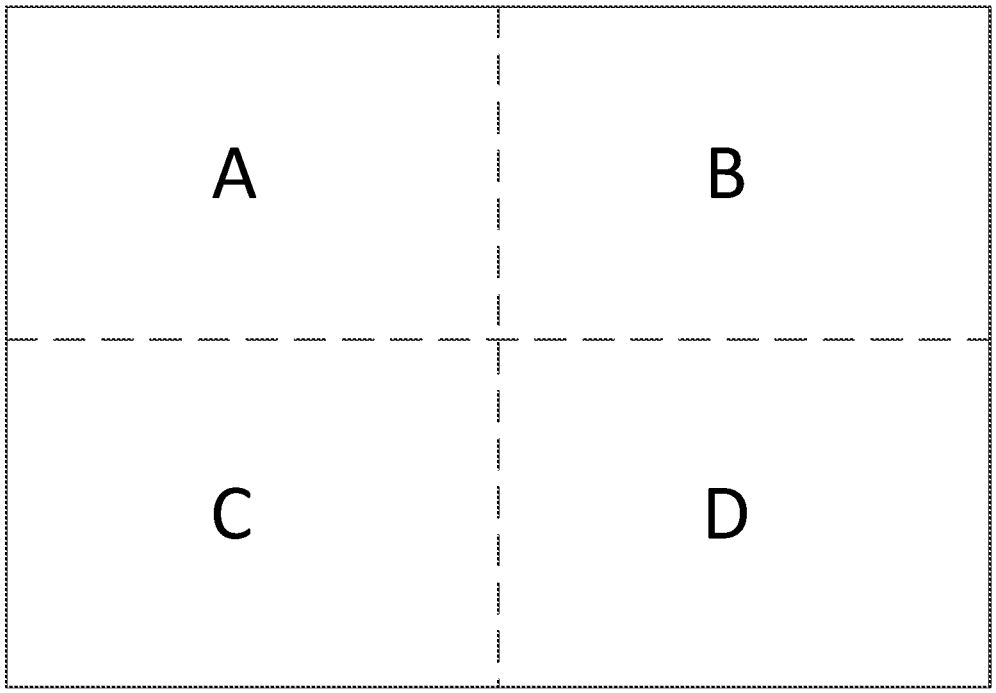
FIG. 3A is another one of schematic structural diagrams of a sub-display region division in a chromaticity compensation method provided by at least an embodiment of the present disclosure.
Figure 3B:
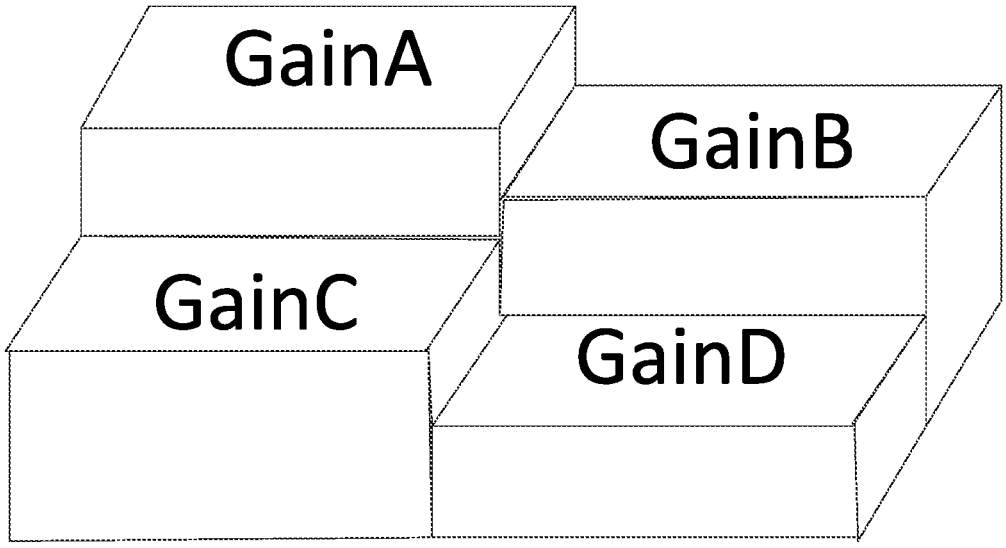
FIG. 3B is a schematic diagram of chromaticity compensation values corresponding to respective sub-display regions in the chromaticity compensation method shown in FIG. 3A.
Figure 3C:
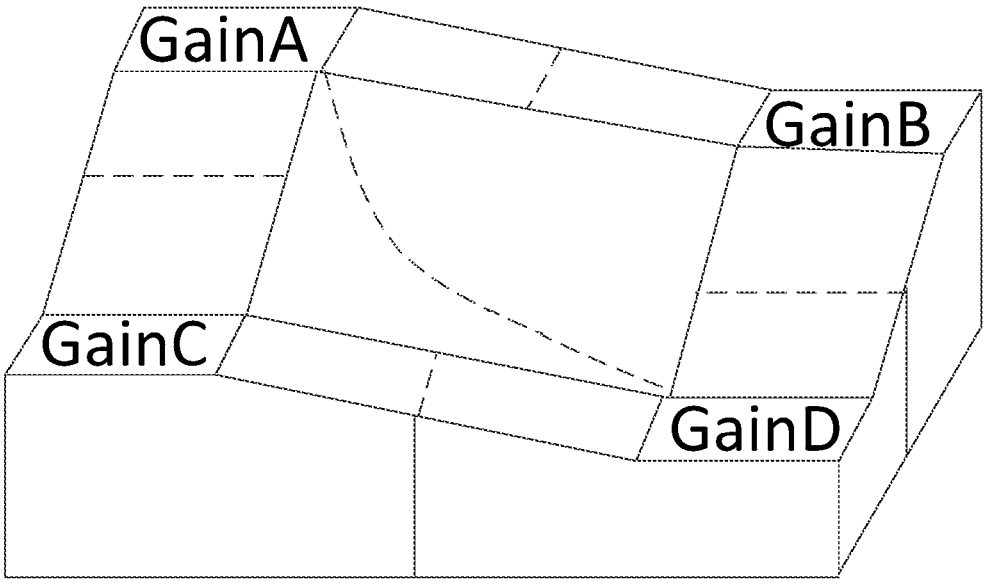
FIG. 3C is a schematic diagram of smoothed chromaticity compensation values of respective sub-display regions in the chromaticity compensation method shown in FIG. 3A.

FIG. 3A is one of structurally schematic diagrams illustrating the sub-display region division in a chromaticity compensation method provided by at least an embodiment of the present disclosure, FIG. 3B is a schematic diagram illustrating chromaticity compensation values corresponding to sub-display regions in the chromaticity compensation method shown in FIG. 3A, and FIG. 3C is a schematic diagram illustrating smoothed chromaticity compensation values of the sub-display regions in the chromaticity compensation method shown in FIG. 3A.

As shown in FIG. 3A, in the chromaticity compensation method provided by the present embodiment, a display region includes a plurality of sub-display regions closely arranged in a first direction and a plurality of sub-display regions closely arranged in a second direction, That is, the display region includes a plurality of sub-display regions arranged in an array. For example, the first direction is perpendicular to the second direction. In the following, the chromaticity compensation method provided by this embodiment will be described in detail with reference to an example in which a display region includes four sub-display regions A, B, C and D (shown in FIG. 3A), which are closely arranged (namely, arranged in an array) in the first direction and the second direction.

For example, in some examples, as shown in FIG. 3A, a display region is divided into four sub-display regions A, B, C and D, arranged closely (namely, arranged in an array) in the first direction and the second direction. For example, in step S101, chromaticity compensation values GainA, GainB, GainC and GainD corresponding to sub-display regions may be determined based on a preset standard chromaticity value and measured chromaticity values corresponding to the sub-display regions (for concrete details, reference may be made to the foregoing description about step S101). For example, chromaticity compensation values corresponding to the sub-display regions are shown in FIG. 3B.

For example, in some examples, in step S102, chromaticity compensation values corresponding to two sub-display regions adjacent in the first direction can be smoothed with a linear interpolation method, so that the chromaticity compensation value corresponding to each sub-pixel in the two sub-display regions adjacent in the first direction after linear smoothing is determined. Regarding the concrete implementing process of the linear interpolation method, reference may be made to the relevant description of embodiment shown in FIG. 2A to FIG. 2C, and it is not elaborated here again. At the same time, it is also possible that chromaticity compensation values corresponding to two sub-display regions adjacent in a second direction is smoothed with a linear interpolation method, so that the chromaticity compensation value corresponding to each sub-pixel in the two sub-display regions adjacent in the second direction after linear smoothing is determined. Regarding the concrete implementing process, reference may also be made to the relevant description of the embodiment as shown in FIG. 2A to FIG. 2C (i.e., taking the second direction as the first direction in the embodiment shown in FIG. 2A to FIG. 2C), and it is not elaborated here again.

For example, in some examples, in step S102, as shown in FIG. 3C, for four sub-display regions A, B, C and D, which are closely arranged in the first direction and the second direction, chromaticity compensation values GainA, GainB, GainC and GainD corresponding to sub-display regions may be taken as chromaticity compensation values of corner zones of the sub-display regions (that is, portions of each sub-display region far from other three sub-display regions, for example, they are such as rectangular zones where GainA, GainB, GainC and GainD are located in FIG. 3C). For a center zone of four sub-display regions A, B, C and D closely arranged in the first direction and the second direction (that is, it is such as a rectangular zone enclosed by connecting lines of center points of A, B, C and D), chromaticity compensation values (GainA, GainB, GainC and GainD) corresponding to the four sub-display regions may be smoothed by using a bilinear interpolation method, to determine the chromaticity compensation value corresponding to each sub-pixel within the center zone after bilinear smoothing. For other four zones (that is, four zones other than the four corner zones and the center zone) of the four sub-display regions A, B, C and D closely arranged in the first direction and the second direction, the smoothed chromaticity compensation value of each sub-pixel in each of the other zones may be obtained by a linear interpolation based on the chromaticity compensation values of two corner zones. Regarding the concrete implementing process, reference may be made to the relevant description of embodiment shown in FIG. 2A to FIG. 2C, and it will not be elaborated here again. In the chromaticity compensation method provided in this example, for a plurality of sub-display regions arranged in an array, after chromaticity compensation values corresponding to twos of sub-display regions adjacent in the first direction and the second direction are each smoothed by linear interpolation, a place where connection is not smoothed may still exist in a center zone of the four sub-display regions. Therefore, the center zone may also be subjected to a bilinear smoothing treatment, so as to make the chromaticity compensation value corresponding to each sub-pixel within each sub-display region in a smooth transition state. Consequently, the chromaticity difference between adjacent sub-pixels of the display panel is smaller, and the quality of a display picture is improved further.

Figure 4:
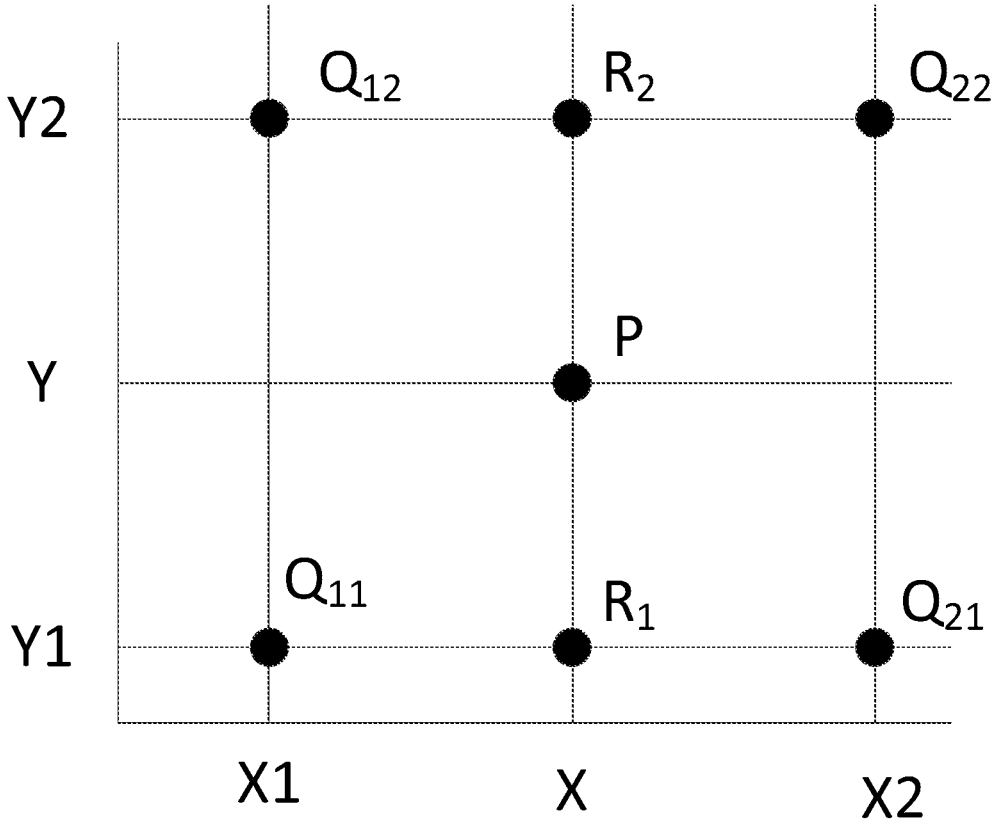
FIG. 4 is a schematic diagram illustrating the principle of a bi-linear interpolation method provided by at least an embodiment of the present disclosure.

FIG. 4 is a schematic diagram illustrating the principle of bilinear interpolation method provided by at least an embodiment of the present disclosure. Hereinafter, in conjunction with FIG. 4, the process in which bilinear interpolation method is used to smooth the above center zone in the embodiment shown in FIG. 3C will be described in detail. The bilinear interpolation method is also called as a bilinear internal interpolation method. In mathematics, bilinear interpolation is the linear interpolation extension of an interpolation function with two variables, and the core idea is to carry out linear interpolation once in two directions, respectively.

As shown in FIG. 4, Q11, Q12, Q21 and Q22 (which may correspond to four vertices of the above center zone, respectively) are known, but the point to be interpolated is point P (which may correspond to any of sub-pixels within the above center zone), and this requires the use of bilinear interpolation. First of all, linear interpolation is carried out in the X direction (which may correspond to the first direction), and the following results are obtained:

$$f(R_1) = \frac{X_2 - X}{X_2 - X} f(Q_{11}) + \frac{X - X_2}{X_2 - X_1} f(Q_{21});$$

-continued $$f(R_1) = \frac{X_2 - X}{X_2 - X_1} f(Q_{11}) + \frac{X - X_2}{X_2 - X_1} f(Q_{21});$$

$$R_1 = (X, Y_1), R_2 = (X, Y_2);$$

The linear interpolation is carried out in the Y direction (which may correspond to the second direction), and the following results are obtained:

$$f(P) = \frac{Y_2 - Y}{Y_2 - X_1} f(R_1) + \frac{Y - Y_2}{Y_2 - Y_1} f(R_2),$$

$$P = (X, Y);$$

$$f(X, Y) = \frac{f(Q_{11})}{(X_2 - X_1)(Y_2 - Y_1)}(X_2 - X)(Y_2 - Y) + \frac{f(Q_{21})}{(X_2 - X_1)(Y_2 - Y_1)}(X - X_1)(Y_2 - Y) + \frac{f(Q_{22})}{(X_2 - X_1)(Y_2 - Y1)}(X_2 - X)(Y - Y_1) + \frac{f(Q_{22})}{(X_2 - X_1)(Y_2 - Y1)}(X - X_1)(Y - Y_1)$$

That is to say, the chromaticity compensation value corresponding to each sub-pixel within a center zone of four sub-display regions is obtained by the bilinear interpolation method mentioned above.

With the chromaticity compensation method provided by an embodiment of the present disclosure, by means of dividing a display region into a plurality of sub-display regions in a close arrangement, chromaticity compensation values corresponding to the sub-display regions, respectively, are determined according to a preset standard chromaticity value and measured chromaticity values corresponding to the sub-display regions; by conducting a smoothing treatment of the chromaticity compensation values corresponding to the sub-display regions, the smoothed chromaticity compensation value of each sub-pixel within each sub-display region is determined. Upon display, the smoothed chromaticity compensation value is used to conduct chromaticity compensation of each sub-pixel, so as to realize a chromaticity compensation of sub-pixels in different places of the display region accordingly and reduce the chromaticity difference of a display picture.

Figure 5:
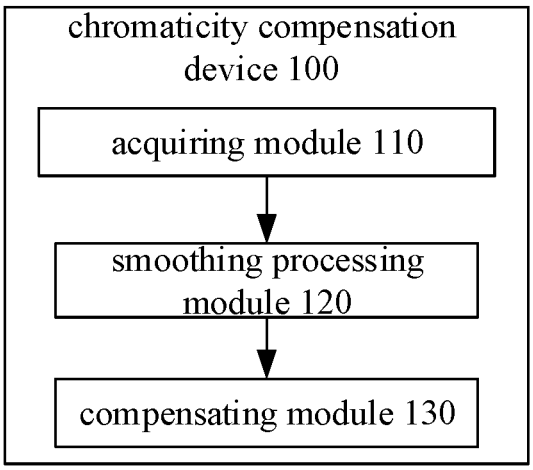
FIG. 5 is a schematic block diagram of a chromaticity compensation device provided by at least an embodiment of the present disclosure.

According to at least an embodiment of the present disclosure, there is also provided a chromaticity compensation device. FIG. 5 is a schematic block diagram illustrating a chromaticity compensation device provided by at least an embodiment of the present disclosure. As shown in FIG. 5, the chromaticity compensation device 100 includes an acquiring module 110, a smoothing processing module 120, and a compensating module 130.

The acquiring module 110 is configured to determine chromaticity compensation values of sub-display regions according to a preset standard chromaticity value and measured chromaticity values corresponding to a plurality of sub-display regions in a display region, wherein the display region is divided into a plurality of sub-display regions which are closely arranged, and each of the sub-display regions includes a plurality of sub-pixels. For example, step S101 may be implemented by the acquiring module 110.

The smoothing processing module 120 is configured to conduct a data smoothing treatment between chromaticity compensation values of adjacent sub-display regions, so that the smoothed chromaticity compensation value of each sub-pixel in each sub-display region is determined. For example, step S102 may be implemented by the smoothing processing module 120.

The compensating module 130 is configured to conduct chromaticity compensation of each sub-pixel by using the smoothed chromaticity compensation value upon display. For example, step S103 may be implemented by the compensating module 130.

For example, in some examples, when a plurality of sub-display regions are closely arranged in the first direction, the smoothing processing module 120 may be configured to smooth chromaticity compensation values corresponding to two sub-display regions adjacent in the first direction by a linear interpolation method, so that the chromaticity compensation value corresponding to each sub-pixel after linearly smoothing is determined. For example, in this example, regarding the process in which a linear interpolation method is adopted by the smoothing processing module 120 for smoothing processing, reference may be made to the description about step S102 in the foregoing embodiment shown in FIG. 2A to FIG. 2C, and it is not elaborated here again.

For example, in some examples, when a plurality of sub-display regions are closely arranged in a second direction and the second direction is perpendicular to a first direction, the smoothing processing module may be configured to smooth chromaticity compensation values corresponding to two sub-display regions adjacent in the second direction by a linear interpolation method, so that the chromaticity compensation value corresponding to each sub-pixel after linear smoothing is determined. For example, in this example, regarding the process in which a linear interpolation method is adopted by the smoothing processing module 120 for smoothing, reference may also be made to the description about step S102 in the foregoing embodiment shown in FIG. 2A to FIG. 2C, and it is not elaborated here again.

For example, in some examples, for a center zone of four sub-display regions that are closely arranged in the first direction and in the second direction, the smoothing processing module may be configured to smooth chromaticity compensation values corresponding to the four sub-display regions by using a bilinear interpolation method, so that the chromaticity compensation value corresponding to each sub-pixel within the center zone after bilinear smoothing is determined. For example, in this example, regarding the process in which bilinear interpolation is adopted by the smoothing processing module 120 for smoothing, reference may be made to the description about step S102 in the foregoing embodiment shown in FIG. 3A to FIG. 3C, and moreover, regarding the principle and process of bilinear interpolation, reference may be made to the description about FIG. 4 in this disclosure, and each of them will not be elaborated any longer here.

Figure 6:
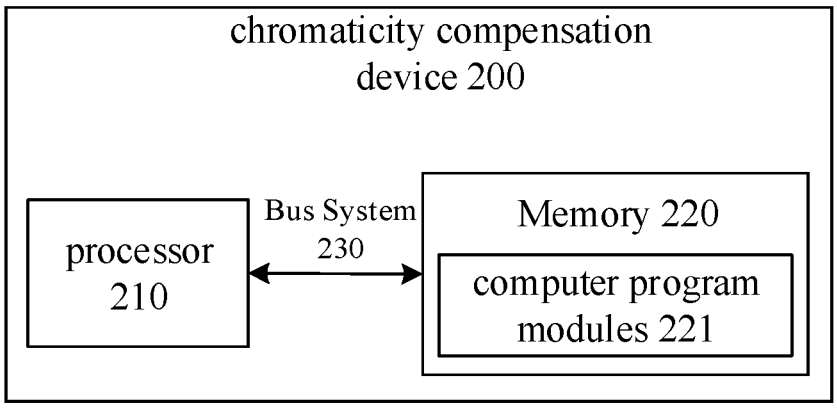
FIG. 6 is a schematic block diagram of another chromaticity compensation device provided by at least an embodiment of the present disclosure.

FIG. 6 is a schematic block diagram illustrating another chromaticity compensation device provided by at least an embodiment of the present disclosure. As shown in FIG. 6, the chromaticity compensation device 200 includes a processor 210, a memory 220, and one or more computer program modules 221.

For example, the processor 210 is connected to the memory 220 via a bus system 230. For example, one or more computer program modules 221 may be stored in the memory 220. For example, one or more computer program modules 221 may include instructions that are run by the processor to cause the executing of the chromaticity compensation method provided by any embodiment of the present disclosure. For example, instructions in the one or more computer program modules 221 may be executed by the processor 210, thereby executing the chromaticity compensation method provided by any embodiment of the present disclosure. For example, the bus system 230 may be a commonly used serial, parallel communication bus, etc., and embodiments of the present disclosure do not set a limit to this.

For example, the processor 210 may be a central processing unit (CPU) or a processing unit of other form with data processing capability and/or instruction execution capability, which may be a general-purpose processor or a dedicated processor, and is capable of controlling other components in the compensating device 200 to perform the desired function. The memory 220 may include one or more computer program products, and the computer program product may include a computer-readable storage medium of diverse form, such as a volatile memory and/or a non-volatile memory. The volatile memory may include, for example, a random access memory (RAM) and/or a cache, etc. The non-volatile memory may include, for example, a read-only memory (ROM), a hard disk, a flash memory, etc. One or more computer program instructions may be stored on the computer-readable storage medium, and the processor 210 may run the program instructions to achieve the function (achieved by the processor 210) in the embodiment of the present disclosure and/or other desired function, such as, a chromaticity compensation method and so on. Various application programs and various data, such as chromaticity compensation values and various data used and/or generated by the application programs, may also be stored in the computer readable storage medium.

It is to be noted that, for the sake of presenting clearly and concisely, components of the above chromaticity compensation device are not given wholly in embodiments of this disclosure. In order to realize necessary functions of the above optical compensating device, those ordinarily skilled in the art can provide and set up other unshown components according to the specific needs, and embodiments of the present disclosure do not set a limit to this.

The implementation principle of the chromaticity compensation device provided by an embodiment of the present disclosure is consistent with the principle of the chromaticity compensation method provided by an embodiment of the present disclosure, and therefore, the chromaticity compensation device may be implemented by referring to principle of the chromaticity compensation method provided by an embodiment of the present disclosure. And regarding the technical effect of the chromaticity compensation device, reference may be made to the technical effect of the chromaticity compensation method provided by an embodiment of the present disclosure, details being omitted here.

According to at least an embodiment of the present disclosure, there is also provided a storage medium, including program codes, used to enable a computing device to execute steps of the above chromaticity compensation method when the program codes are running on the computing device. The principle of solving problem of the storage medium is similar to the chromaticity compensation method provided by any embodiment of the present disclosure, and thus for the implementation of the storage medium, reference may be made to the implementation of the chromaticity compensation method, repetitions being omitted here.

For example, any combination of one or more computer-readable media may be adopted by the storage medium. The readable medium may be a readable signal medium or a readable storage medium. The readable storage medium may, for example, include but is not limited to, an electrical, magnetic, optical, electromagnetic, infrared, or semiconductor system, apparatus or device, or any combination of above readable storage media. For example, the readable storage medium may include an electrical connection with one or more wires, a portable disk, a hard disk, a random access memory (RAM), a read-only memory (ROM), an erasable, programmable read-only memory (EPROM or flash memory), an optical fiber, a portable compact disk read-only memory (CD-ROM), an optical memory device, a magnetic memory device, or any suitable combination of the above, and may also be other suitable nonvolatile storage medium.

For display products according to the embodiments of the present invention, it may adopt a portable compact disk read-only memory (CD-ROM) and include program codes, and can run on a server equipment. However, program products of the present disclosure are not limited to this, and in this document, the readable storage medium may be any tangible medium containing or storing a program, which may be used by information transmission, apparatus or device, or be used in conjunction with it.

The readable signal medium may include a data signal transmitted in a baseband or as part of a carrier wave, in which readable program codes are carried. Such transmitted data signal may take many forms, including, but not limited to, electromagnetic signal, optical signal, or any suitable combination of the above. The readable signal medium may also be any readable medium other than a readable storage medium, and the readable medium may send, pass on or transmit a program to be used by a periodic network action system, apparatus or device or to be used in conjunction with it.

Program codes contained in the readable medium may be transmitted with any appropriate medium, including, but not limited to, wireless, wired, optical cable, RF, etc., or any appropriate combination of the above.

The program codes for performing operations of the present invention may be written by any combination of one or more programming languages, and the programming language includes an object-oriented programming language such as Java, C++, etc., and also includes a regular procedural programming language such as "C" language or similar programming language. The program codes may be executed wholly on a user computing device, executed partly on a user device, executed as a separate software package, executed partly on a user computing device and partly on a remote computing device, or executed wholly on a remote computing device or server. In cases of involving a remote computing device, the remote computing device may be connected to a user computing device over a network of any kind, including a local area network (LAN) or a wide area network (WAN), alternatively, it may be connected to an external computing device.

Through the description of above embodiments, those ordinarily skilled in the art can clearly understand that embodiments of the present disclosure may be implemented by hardware, and may also be implemented by aid of software plus a necessary general hardware platform. Based on this understanding, technical solutions of embodiments of the present invention may be embodied in the form of a software product, and the software product may be stored in a non-volatile storage medium (which may be a CD-ROM, U disk, mobile hard disk, etc.), and includes a number of instructions enabling a computer device (which may be a personal computer, a server, or a network device, etc.) to execute the method described in each embodiment of the present disclosure.

As can be understood by those skilled in the art, modules in a device in an embodiment may be distributed in the device of the embodiment as described in the embodiment, and may also be varied accordingly so as to be located in one or more devices different from the present embodiment. The modules of the above embodiment may be merged into one module, and may also be further divided into multiple sub-modules.

The following statements should be noted:

(1) The accompanying drawings related to the embodiment(s) of the present disclosure involve only the structure (s) in connection with the embodiment(s) of the present disclosure, and other structure(s) can be referred to common design(s).

(2) In case of no conflict, features in one embodiment or in different embodiments can be combined.

What have been described above are only specific implementations of the present disclosure, the protection scope of the present disclosure is not limited thereto. Therefore, the protection scope of the present disclosure should be based on the protection scope of the claims.

What is claimed is:

1. A chromaticity compensation method, comprising:

based on a preset standard chromaticity value and measured chromaticity values corresponding to a plurality of sub-display regions in a display region, determining chromaticity compensation values of respective sub-display regions, wherein the display region is divided into the plurality of sub-display regions in a close arrangement, and each of the sub-display regions comprises a plurality of sub-pixels;

conducting a data smoothing treatment between the chromaticity compensation values of respective sub-display regions that are adjacent and determining smoothed chromaticity compensation values of respective sub-pixels in the respective sub-display regions; and upon display, chromatically compensating the respective sub-pixels by using the smoothed chromaticity compensation values, wherein for a center zone of four of the sub-display regions closely arranged in a first direction and a second direction, the conducting the data smoothing treatment between the chromaticity compensation values of the respective sub-display regions that are adjacent and determining the smoothed chromaticity compensation values of respective sub-pixels in the respective sub-display regions comprises:

smoothing the chromaticity compensation values corresponding to the four of the sub-display regions by using a bi-linear interpolation method, and determining bi-linearly smoothed chromaticity compensation values corresponding to sub-pixels within the center zone as the smoothed chromaticity compensation values as follows, $$f(X, Y) = \frac{f(Q_{11})}{(X_2 - X_1)(Y_2 - Y_1)}(X_2 - X)(Y_2 - Y) + \frac{f(Q_{21})}{(X_2 - X_1)(Y_2 - Y_1)}(X - X_1)(Y_2 - Y) + \frac{f(Q_{12})}{(X_2 - X_1)(Y_2 - Y1)}(X_2 - X_1)(Y - Y_1) +$$

-continued $$\frac{f(Q_{22})}{(X_2 - X_1)(Y_2 - Y1)}(X - X_1)(Y - Y_1),$$

wherein the first direction and the second direction are perpendicular to each other and the center zone is formed by connecting lines of center points of the four of the sub-display regions, wherein, in the first direction and the second direction, (X, Y) corresponds to a coordinate of any of the sub-pixels within the center zone, $Q_{11}$, $Q_{12}$, $Q_{21}$ and $Q_{22}$ correspond to four vertices of the center zone, and a coordinate of $Q_{11}$ is $(X_1, Y_1)$, a coordinate of $Q_{12}$ is $(X_1, Y_2)$, a coordinate of $Q_{21}$ is $(X_2, Y_1)$, and a coordinate of $Q_{22}$ is $(X_2, Y_2)$ and $f(Q_{11})$, $f(Q_{12})$, $f(Q_{21})$, and $f(Q_{22})$ are chromaticity compensation values of $Q_{11}$, $Q_{12}$, $Q_{21}$ and $Q_{22}$ respectively.

2. The chromaticity compensation method according to claim 1, wherein the plurality of sub-display regions are closely arranged in the first direction, and wherein the conducting the data smoothing treatment between the chromaticity compensation values of the respective sub-display regions that are adjacent and determining the smoothed chromaticity compensation values of respective sub-pixels in the respective sub-display regions comprises:

smoothing the chromaticity compensation values corresponding to two of the sub-display regions adjacent in the first direction by using a linear interpolation method, and determining the linearly smoothed chromaticity compensation values corresponding to the respective sub-pixels as the smoothed chromaticity compensation values.

3. The chromaticity compensation method according to claim 2, wherein the plurality of sub-display regions are closely arranged in the second direction, and wherein the conducting the data smoothing treatment between the chromaticity compensation values of the respective sub-display regions that are adjacent and determining the smoothed chromaticity compensation values of respective sub-pixels in the respective sub-display regions comprises:

smoothing the chromaticity compensation values corresponding to two of the sub-display regions adjacent in the second direction by using the linear interpolation method, and determining the linearly smoothed chromaticity compensation values corresponding to the respective sub-pixels as the smoothed chromaticity compensation values.

4. The chromaticity compensation method according to claim 1, wherein the determining the chromaticity compensation values of the respective sub-display regions comprises:

acquiring measured chromaticity values of center positions of the respective sub-display regions; and according to a difference between the measured chromaticity values and the preset standard chromaticity value, determining the chromaticity compensation values corresponding to the respective sub-display regions.

5. A nonvolatile storage medium, comprising a program code, wherein upon the program code being run on a computing device, the program code is executed to cause the computing device to execute steps of the chromaticity compensation method according to claim 1.

6. A chromaticity compensation device, comprising:

a processor;

a memory;

one or a plurality of computer program modules, wherein the one or the plurality of computer program modules are stored in the memory and are configured to be executed by the processor, upon the one or the plurality of computer program modules being executed by the processor, the following method is executed:

based on a preset standard chromaticity value and measured chromaticity values corresponding to a plurality of sub-display regions in a display region, determining chromaticity compensation values of respective sub-display regions, wherein the display region is divided into the plurality of sub-display regions in a close arrangement, each of the sub-display regions comprises a plurality of sub-pixels;

conducting a data smoothing treatment between the chromaticity compensation values of respective sub-display regions that are adjacent, and determining smoothed chromaticity compensation values of respective sub-pixels in the respective sub-display regions; and upon display, chromatically compensating the respective sub-pixels by using the smoothed chromaticity compensation values, wherein for a center zone of four of the sub-display regions closely arranged in a first direction and a second direction, the conducting the data smoothing treatment between the chromaticity compensation values of the respective sub-display regions that are adjacent and the determining the smoothed chromaticity compensation values of respective sub-pixels in the respective sub-display regions comprises:

smoothing the chromaticity compensation values corresponding to the four of the sub-display regions by using a bi-linear interpolation method, and determining bi-linearly smoothed chromaticity compensation values corresponding to sub-pixels within the center zone as the smoothed chromaticity compensation values as follows, $$f(X, Y) = \frac{f(Q_{11})}{(X_2 - X_1)(Y_2 - Y_1)}(X_2 - X)(Y_2 - Y) + \frac{f(Q_{21})}{(X_2 - X_1)(Y_2 - Y_1)}(X - X_1)(Y_2 - Y) + \frac{f(Q_{12})}{(X_2 - X_1)(Y_2 - Y1)}(X_2 - X_1)(Y - Y_1) + \frac{f(Q_{22})}{(X_2 - X_1)(Y_2 - Y1)}(X - X_1)(Y - Y_1),$$

wherein the first direction and the second direction are perpendicular to each other and the center zone is formed by connecting lines of center points of the four of the sub-display regions, wherein, in the first direction and the second direction, (X, Y) corresponds to a coordinate of any of the sub-pixels within the center zone, $Q_{11}$, $Q_{12}$, $Q_{21}$ and $Q_{22}$ correspond to four vertices of the center zone, and a coordinate of $Q_{11}$ is $(X_1, Y_1)$, a coordinate of $Q_{12}$ is $(X_1, Y_2)$, a coordinate of $Q_{21}$ is $(X_2, Y_1)$, and a coordinate of $Q_{22}$ is $(X_2, Y_2)$ and $f(Q_{11})$, $f(Q_{12})$, $f(Q_{21})$, and $f(Q_{22})$ are chromaticity compensation values of $Q_{11}$, $Q_{12}$, $Q_{21}$ and $Q_{22}$ respectively.

7. The chromaticity compensation device according to claim 6, wherein upon the one or the plurality of computer program modules being executed by the processor, the following method is further executed:

in a case where the plurality of sub-display regions are closely arranged in the first direction, smoothing the chromaticity compensation values corresponding to two of the sub-display regions adjacent in the first direction by using a linear interpolation method, and determining linearly smoothed chromaticity compensation values corresponding to the respective sub-pixels as the smoothed chromaticity compensation values.

8. The chromaticity compensation device according to claim 7, wherein upon the one or the plurality of computer program modules being executed by the processor, the following method is further executed:

in a case where the plurality of sub-display regions are closely arranged in the second direction, smoothing the chromaticity compensation values corresponding to two of the sub-display regions adjacent in the second direction by the linear interpolation method, and determining the linearly smoothed chromaticity compensation values corresponding to the sub-pixels as the smoothed chromaticity compensation values.

9. The chromaticity compensation device according to claim 6, wherein the determining the chromaticity compensation values of the respective sub-display regions includes:

acquiring measured chromaticity values of center positions of the respective sub-display regions; and according to a difference between the measured chromaticity values and the preset standard chromaticity value, determining the chromaticity compensation values corresponding to the respective sub-display regions.

* * * * *